US006994322B1

(12) United States Patent
Wittman

(10) Patent No.: US 6,994,322 B1
(45) Date of Patent: Feb. 7, 2006

(54) FROZEN VEHICLE DOOR PULLER

(76) Inventor: Ryan Wittman, 4141 Clevenger Ave., Billings, MT (US) 59101

( * ) Notice: Subject to any disclaimer, the term of this patent is extended or adjusted under 35 U.S.C. 154(b) by 0 days.

(21) Appl. No.: 11/001,430

(22) Filed: Dec. 1, 2004

(51) Int. Cl.
*B66F 11/00* (2006.01)

(52) U.S. Cl. ..... 254/131; 254/25

(58) Field of Classification Search ..... 254/131, 254/25, 28; 269/6, 3; 29/278
See application file for complete search history.

(56) References Cited

U.S. PATENT DOCUMENTS

| | | | | |
|---|---|---|---|---|
| D168,831 | S | 2/1953 | Derlein | |
| 2,967,730 | A * | 1/1961 | Vann | 294/62 |
| 3,751,785 | A * | 8/1973 | Whitesell | 29/267 |
| 4,211,446 | A * | 7/1980 | Shultz, Sr. | 294/26 |
| D265,269 | S | 7/1982 | Frantz | |
| D293,499 | S | 12/1987 | Senecal et al. | |
| D324,747 | S | 3/1992 | Rood | |
| 5,251,351 | A | 10/1993 | Koltz | |
| 5,542,139 | A | 8/1996 | Boivin | |
| 5,564,148 | A | 10/1996 | Prevost et al. | |
| 5,960,745 | A | 10/1999 | Boyland | |
| D416,390 | S | 11/1999 | Corriveau | |
| 6,202,986 | B1 * | 3/2001 | Goldman | 254/131 |
| 6,494,512 | B1 | 12/2002 | Cada et al. | |
| 6,574,816 | B2 | 6/2003 | Yu Chen | |
| 2005/0022631 | A1 * | 2/2005 | Brazil | 81/119 |

* cited by examiner

*Primary Examiner*—Lee D. Wilson
(74) *Attorney, Agent, or Firm*—Antoinette M. Tease

(57) ABSTRACT

A frozen vehicle door puller comprising a key ring, a finger plate, an eyelet, a finger handle, a body, and a hook. Preferably, the finger handle is slightly larger in diameter than the body in order to provide a comfortable grip for the user's fingers, and the overall length of this embodiment from the finger plate to the end of the hook is in the range of five (5) to ten (10) centimeters. The frozen vehicle door puller is alternately comprised of a handle, a shaft, and one or more interchangeable hooks. Preferably, the overall length of this embodiment is between forty-five (45) and sixty (60) centimeters. In each embodiment, the hook is coated with silicone or rubber to prevent it from damaging the vehicle's paint. A method of using the frozen vehicle door pullers of the present invention to open a frozen vehicle door.

9 Claims, 3 Drawing Sheets

FROZEN VEHICLE DOOR PULLER

BACKGROUND OF THE INVENTION

1. Field of the Invention

The present invention relates to the field of automotive hand implements, and more particularly, to a device that can be used to pry open a frozen vehicle door.

2. Description of the Related Art

There are a number of design patents for automotive ice scrapers or other types of scrapers, and there are also several utility patents for emergency car tools. None of these inventions, however, serves the function of the present invention, namely, to pry open a frozen car door, and none possesses the simplicity and structural attributes of the present invention. These inventions are discussed below in chronological order from oldest to most recent.

U.S. Pat. No. D168,831 (Derlein, 1951) is a design patent for a combined coat hanger and ice scraper for automobiles. The device has a hook, but the hook is designed for hanging clothes—not for opening frozen car doors. There are in fact two clothes hooks to this device, and neither hook could be used to open a car door because the ends of the hooks are too blunt and also because of the orientation of the hooks in relation to the rest of the device.

U.S. Pat. No. D265,269 (Frantz, 1982) is a design patent for an ice scraper with an attached snow brush. This invention is distinguishable from the present invention because it does not include a hook for prying open a frozen car door.

U.S. Pat. No. D293,499 (Senecal et al., 1987) is a design patent for a scraper. The scraper has a protrusion that extends laterally, but it is not a hook, and it would not work for prying open frozen car doors because the protrusion is not shaped so that it could curve around the edge of a car door.

U.S. Pat. No. 5,251,351 (Klotz, 1993) provides a combination tool for motor vehicles. The tool comprises an ice scraper and/or a squeegee for removing moisture, an emergency hammer and/or a cutting element and/or a sharpening element for wiper blades and/or a container for a slip and/or lubricating agent on a handle. The primary functions of this tool are ice scraping and water removal. The tool also functions as an emergency hammer, belt cutter, wiper blade sharpener and lubrication agent dispenser. Although this tool obviously has many functions, one thing it does not do is pry open frozen car doors.

U.S. Pat. No. 5,542,139 (Boivin, 1996) describes a multipurpose tool for cutting, prying and punching in the event of an emergency situation. The cutting and punching aspects of this invention are not relevant to the present invention. The prying aspect is a blunt end on the tip of a blade with a serrated cutting edge. This tool could not be used to pry open a frozen car door because the blunt end would not fit around the edge of the car door, and the blade would damage the vehicle's paint.

U.S. Pat. No. D416,390 (Corriveau, 1999) is a design patent for a brush handle with a blade. The blade is not a hook, and it is not designed for prying open a car door. In fact, a blade would damage the paint on a vehicle.

U.S. Pat. No. 6,574,816 (Yu Chen, 2003) involves another emergency tool for automobiles. This tool combines a knife for cutting a seatbelt, a hammer specially designed for breaking open a window, and two different screwdrivers. This tool does not include any feature that could be used for prying open a frozen car door.

It is an object of the present invention to provide an implement that can be used to open frozen vehicle doors when a person's fingers cannot get around the edge of the door to pull it open. It is a further object of the present invention to provide two different embodiments of the frozen vehicle door puller—one that can be carried on a key chain and another that can be kept in a person's home or office.

BRIEF SUMMARY OF THE INVENTION

The present invention is a frozen vehicle door puller comprising a key ring, a finger plate, an eyelet, a finger handle, a body, and a hook, wherein the key ring is attached to the finger plate by the eyelet. In the preferred embodiment, the finger handle is slightly larger in diameter than the body in order to provide a comfortable grip for the user's fingers. In this first embodiment, the key ring and eyelet are made of metal, and the finger plate, finger handle, body and hook are made of rigid plastic. The overall length of this first embodiment from the finger plate to the end of the hook is preferably in the range of five (5) to ten (10) centimeters.

In an alternate embodiment, the frozen vehicle door puller is comprised of a handle, a shaft, and one or more interchangeable hooks. The shaft comprises a threaded end, and the interchangeable hooks are threaded on the inside so that they can fit over the threaded end of the shaft. Different size hooks can be manufactured and sold with this embodiment so that the user can choose the hook configuration that best works with his or her vehicle(s). In this embodiment, the handle, shaft and interchangeable hook(s) are all made of rigid plastic. Preferably, the overall length of this embodiment from the end of the handle to the end of the interchangeable hook is between forty-five (45) and sixty (60) centimeters.

In each of the above embodiments, the hook is coated with silicone or rubber to prevent it from damaging the vehicle's paint.

The present invention also covers a method of using the frozen vehicle door pullers described above to open a frozen vehicle door.

REFERENCE NUMBERS

Figure 1:
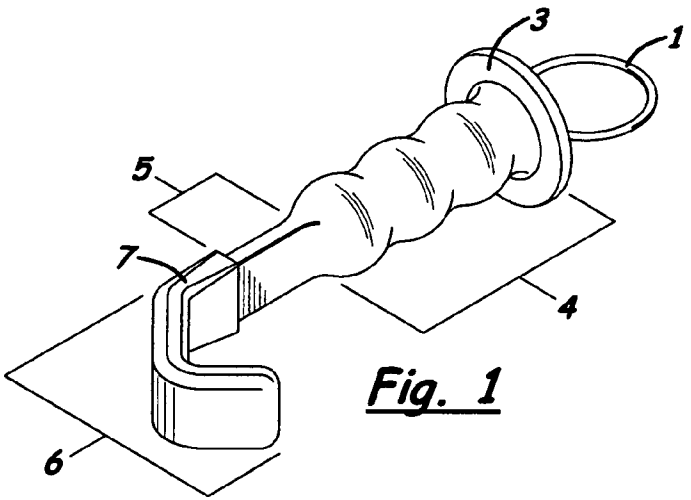
FIG. 1 is a perspective view of the keychain embodiment of the present invention.

1 Key ring
2 Eyelet
3 Finger plate
4 Finger handle
5 Body
6 Hook
7 Silicone/rubber
8 Handle
9 Shaft (main body)
10*a* Threaded end of shaft
10*b* Threaded extension of interchangeable hook
11 Interchangeable hook

DETAILED DESCRIPTION OF INVENTION

The present invention is intended to be used with vehicles that sit for a long enough period of time in cold weather that their doors freeze shut. This can happen with rental cars, for example, that sit in lots for long periods of time, or with vehicles that are parked in an unheated parking garage while the owner is at work. This can also happen at ski resorts, where vehicles sit outside all day, often in snowy weather, or even at home if a vehicle is parked outside. The present invention is useful in all of these situations, and any other situation in which a vehicle's doors might freeze shut and the owner cannot get his or her fingers around the edge of the door to pry it open-either because his or her fingers are too big or too cold.

FIG. 1 is a perspective view of the keychain embodiment of the present invention. This embodiment comprises a key ring 1 that is attached to a finger plate 3 by an eyelet (shown in FIG. 2). Adjacent to the finger plate 3 on the opposite side of the eyelet 2 is a finger handle 4. In the preferred embodiment, and as shown in FIG. 1, the finger handle 4 is larger in diameter than the body 5, and it is also contoured to provide a comfortable finger grip area. At the end of the body 5 opposite the key ring 1 is a hook 6. The hook can be of any shape, as long as it is sufficiently rigid, sufficiently long and sufficiently curved to fit around the edge of a vehicle door and not break when the user pulls on it. The hooks can even be interchangeable (as shown in connection with the home/office embodiment discussed below) to fit different vehicle types.

Preferably, with the exception of the eyelet 2 and key ring 1, which are made of metal, all other parts of the keychain embodiment of the present invention are made of rigid plastic. The hook 6 is coated with silicone or rubber 7 so that the hook will not damage the paint on the vehicle. The overall length of the keychain embodiment from the finger plate to the end of the hook (see line A—A in FIG. 2) is preferably in the range of five (5) to ten (10) centimeters.

Figure 3:
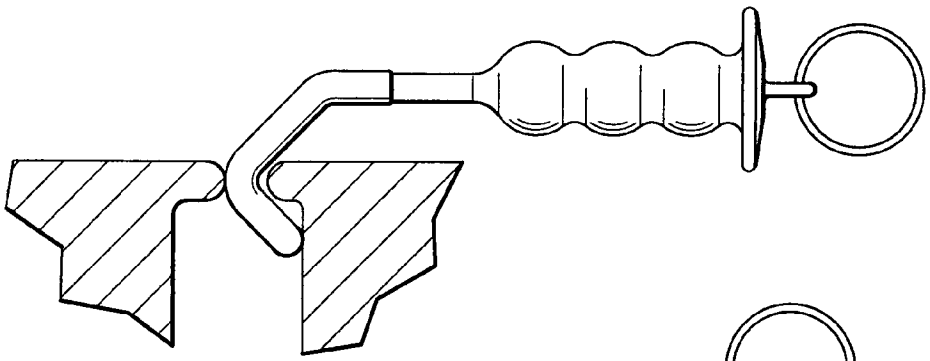
FIG. 3 is a side view of the keychain embodiment of the present invention as it is positioned around the edge of a vehicle door before the door starts to open.
Figure 4:
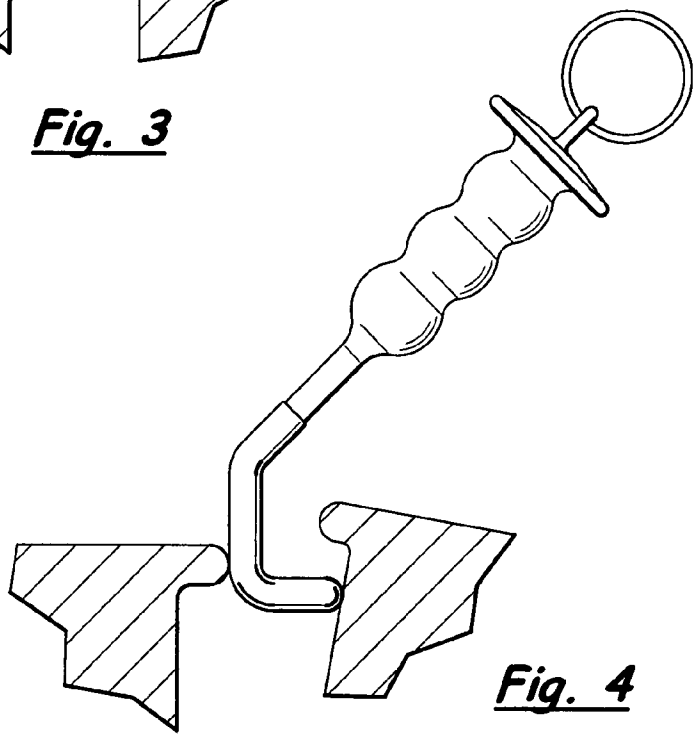
FIG. 4 is a side view of the keychain embodiment of the present invention as it is positioned around the edge of a vehicle door as the door starts to open.

FIGS. 3 and 4 illustrate the position of the hook of the keychain embodiment of the present invention as it is positioned around the edge of a vehicle door. FIG. 3 shows the position of the hook before the door starts to open. FIG. 4 shows the position of the hook as the door starts to open.

Figure 5:
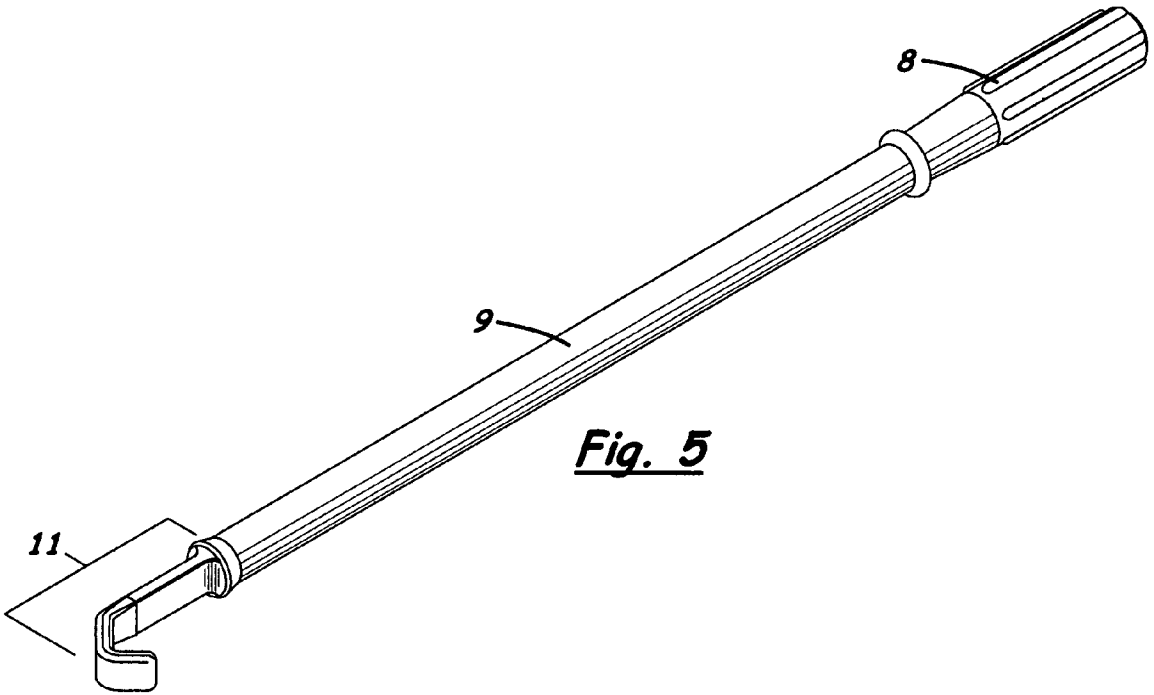
FIG. 5 is a perspective view of the home/office embodiment of the present invention with the hook attached to the handle.

FIG. 5 is a perspective view of the home/office embodiment of the present invention with the hook attached to the handle. This embodiment comprises a handle 8, a shaft 9, and an interchangeable hook 11. As with the hook of the keychain embodiment, the hook can be of any shape, as long as it is sufficiently rigid, sufficiently long and sufficiently curved to fit around the edge of a vehicle door and not break when the user pulls on it. In fact, multiple hook designs can be manufactured and sold with the handle/shaft so that the user can determine which hook works best on his or her vehicle(s). The overall length of the home/office embodiment from the end of the handle 8 to the end of the interchangeable hook 11 (see line B—B in FIG. 6) is preferably in the range of forty-five (45) to sixty (60) centimeters.

Figure 6:
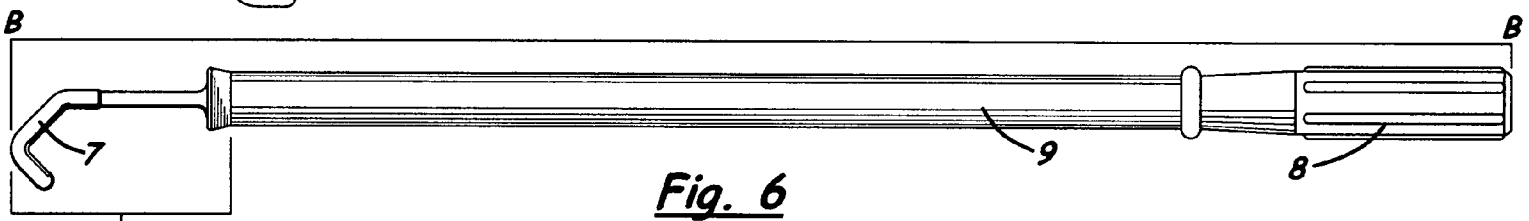
FIG. 6 is a side view of the home/office embodiment of the present invention with the hook attached to the handle.
Figure 7:
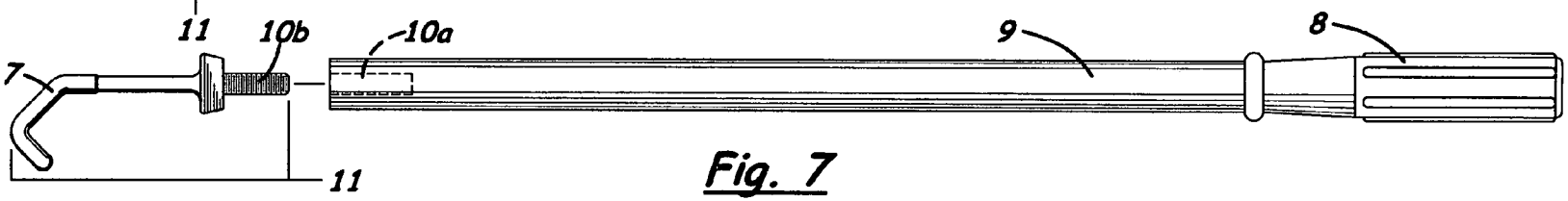
FIG. 7 is a side view of the home/office embodiment of the present invention with the hook disengaged from the handle.

FIG. 6 is a side view of the home/office embodiment of the present invention with the hook attached to the handle. FIG. 7 is a side view of the home/office embodiment of the present invention with the hook disengaged from the handle. As shown in this figure, the inside of the shaft 9 is threaded on one end 10*a*. Each interchangeable hook also has a threaded extension 10*b*, which inserts into the threaded end 10*a* of the shaft. As with the hook of the keychain embodiment, the interchangeable hooks 11 of the home/office embodiment are coated with silicone or rubber 7 so that the hook will not damage the paint on the vehicle.

Figure 2:
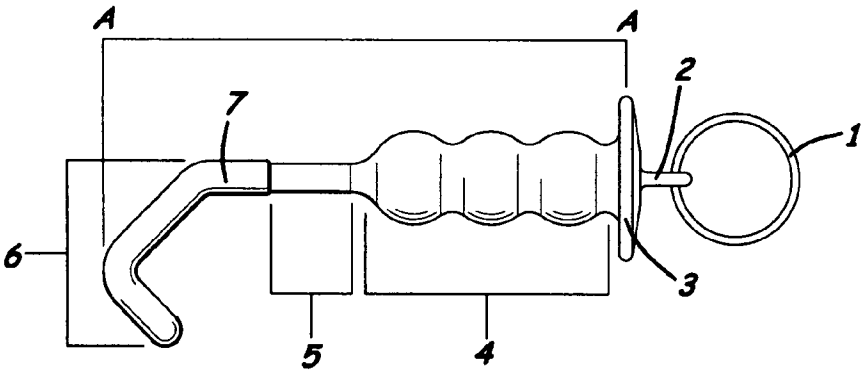
FIG. 2 is a side view of the keychain embodiment of the present invention.
Figure 8:
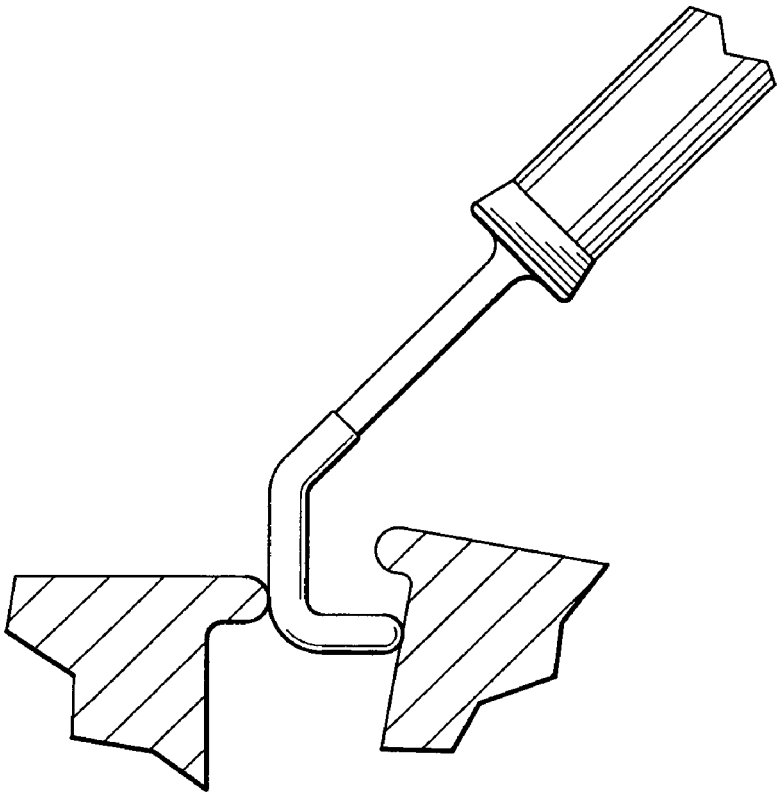
FIG. 8 is a side view of the home/office embodiment of the present invention as it is positioned around the edge of a vehicle door before the door starts to open.
Figure 9:
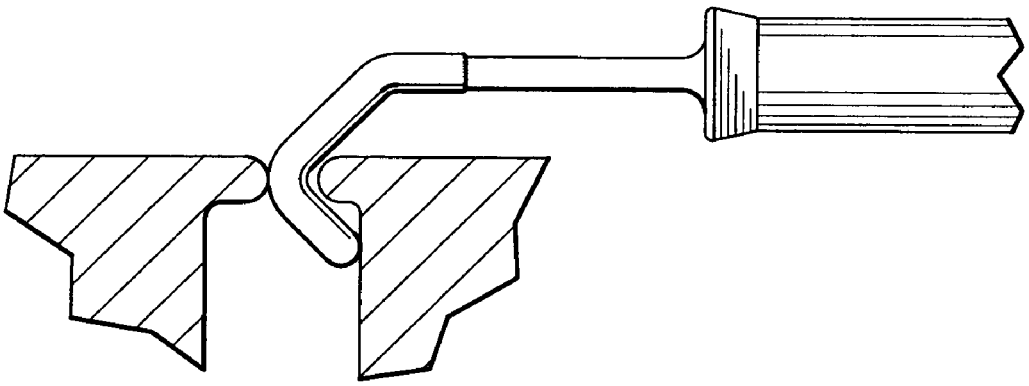
FIG. 9 is a side view of the home/office embodiment of the present invention as it is positioned around the edge of a vehicle door as the door starts to open.

FIGS. 8 and 9 illustrate the position of the hook of the home/office embodiment of the present invention as it is positioned around the edge of a vehicle door. FIG. 2 shows the position of the hook before the door starts to open. FIG. 3 shows the position of the hook as the door starts to open.

Although several preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A frozen vehicle door puller comprising:
(a) a key ring;
(b) a finger plate;
(c) an eyelet;
(d) a finger handle;
(e) a body; and
(f) a hook,
wherein the key ring is attached to the finger plate by the eyelet.

2. The frozen vehicle door puller of claim 1, wherein the finger handle is slightly larger in diameter than the body.

3. The frozen vehicle door puller of claim 1, wherein the finger handle is contoured to provide a comfortable finger grip area.

4. The frozen vehicle door puller of claim 1, wherein the hook is coated with silicone.

5. The frozen vehicle door puller of claim 1, wherein the hook is coated with rubber.

6. The frozen vehicle door puller of claim 1, wherein the key ring and eyelet are comprised of metal, and the finger plate, finger handle, body and hook are comprised of rigid plastic.

7. The frozen vehicle door puller of claim 1, wherein the length of the frozen vehicle door puller from the finger plate to the end of the hook is in the range of five (5) to ten (10) centimeters.

8. The frozen vehicle door puller of claim 1, wherein the hooks are interchangeable.

9. A frozen vehicle door puller comprising:
(a) a handle
(b) a shaft; and
(c) one or more interchangeable hooks,
wherein each interchangeable hook comprises a threaded extension, wherein the end of the shaft opposite the handle is threaded on the inside, and wherein the threaded extension on the interchangeable hook fits into the threaded end of the shaft.

* * * * *